US005829787A

United States Patent [19]

Newhouse, Jr.

[11] Patent Number: 5,829,787

[45] Date of Patent: Nov. 3, 1998

[54] BOOK HOLDER

[76] Inventor: David G. Newhouse, Jr., P.O. Box 25, Newton, N.H. 03858

[21] Appl. No.: 950,786

[22] Filed: Sep. 24, 1992

[51] Int. Cl.[6] ..... B42D 17/00

[52] U.S. Cl. ..... 281/46; 248/444.1; 248/447.2; 248/451

[58] Field of Search ..... 281/34, 45, 46–49; 248/441.1, 444.1, 447, 447.2, 451–53, 445, 455

[56] References Cited

U.S. PATENT DOCUMENTS

| | | | |
|---|---|---|---|
| 768,483 | 8/1904 | Rivers | 248/447.2 |
| 1,400,217 | 12/1921 | Horger . | |
| 3,238,925 | 3/1966 | Swett | 248/447 |
| 3,889,914 | 6/1975 | Torme | 248/447.2 |
| 3,981,522 | 9/1976 | Bloom | 281/34 |
| 4,159,836 | 7/1979 | Tarr | 281/45 |
| 4,296,946 | 10/1981 | Larre et al. | 281/45 |
| 4,987,690 | 1/1991 | Aaldenberg et al. | 248/447 |
| 5,058,848 | 10/1991 | Ferraro | 248/445 |
| 5,069,409 | 12/1991 | Batson | 248/451 |
| 5,120,014 | 6/1992 | Chou | 281/45 |

*Primary Examiner*—Timothy V. Eley
*Assistant Examiner*—Kenneth J. Hansen

[57] ABSTRACT

A book is held on a support having a spring clip on the side. The clip is designed to hold a transparent arm extending across the open book. Depressing the clip lifts the arm, allowing a page to be turned.

12 Claims, 4 Drawing Sheets

FIG. 1
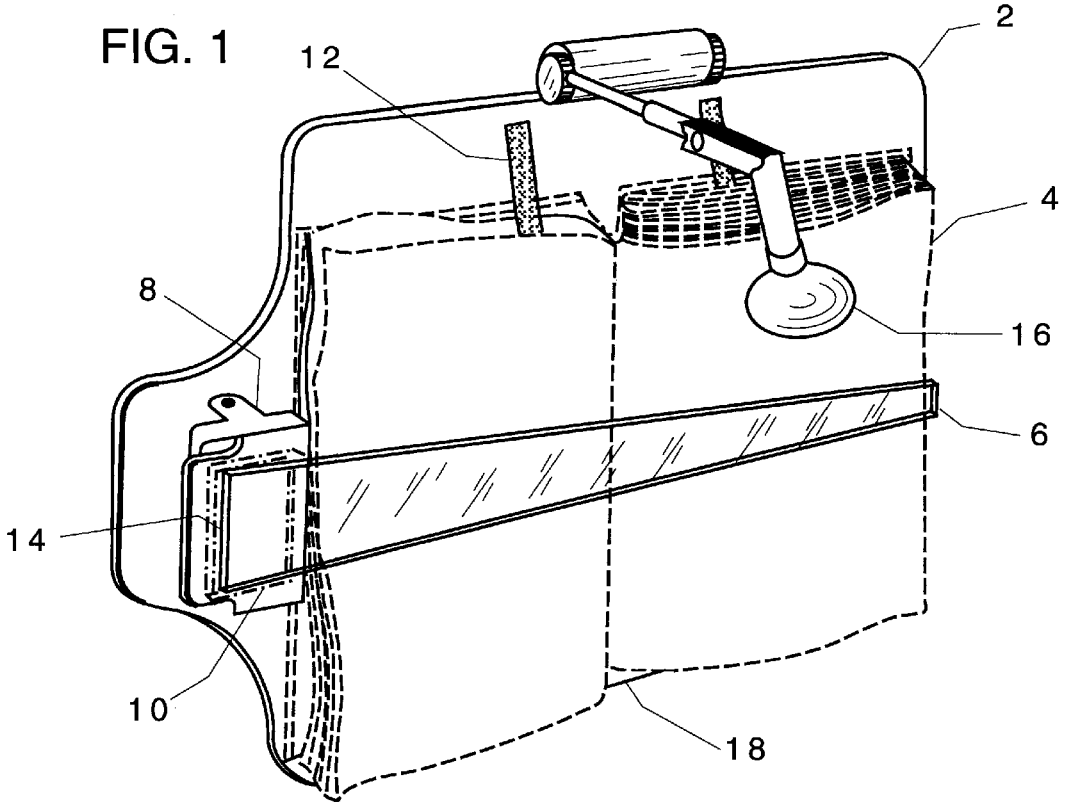
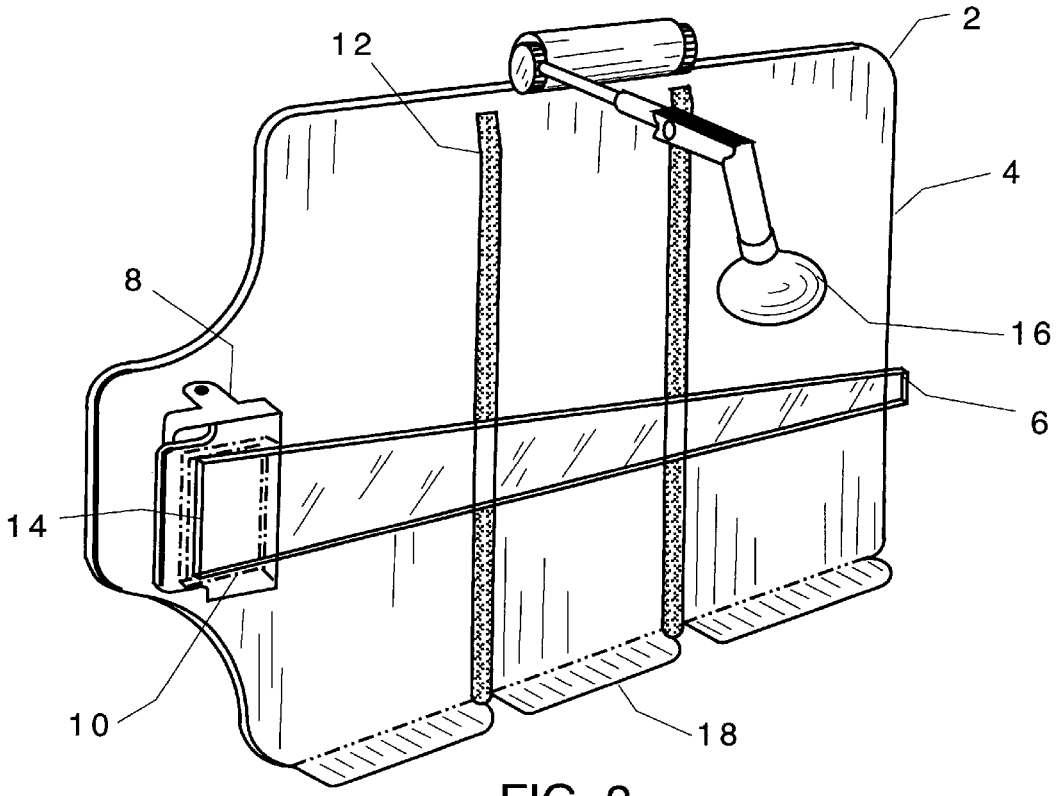
FIG. 2

FIG. 3
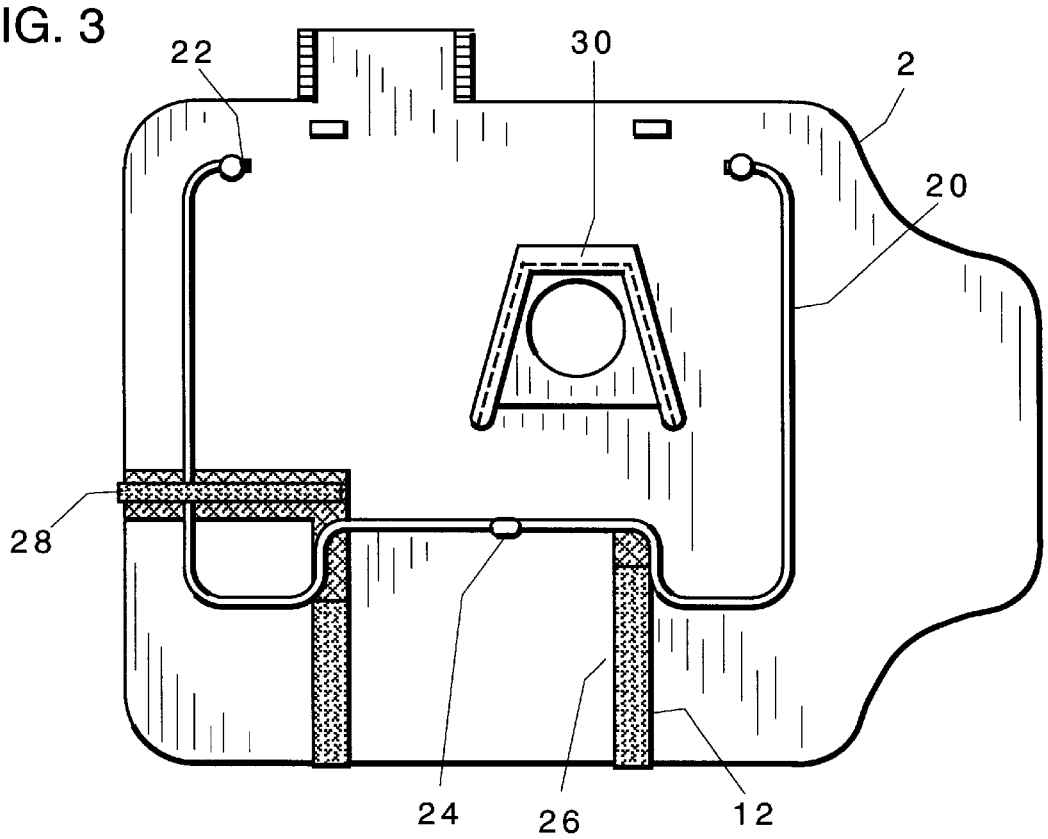
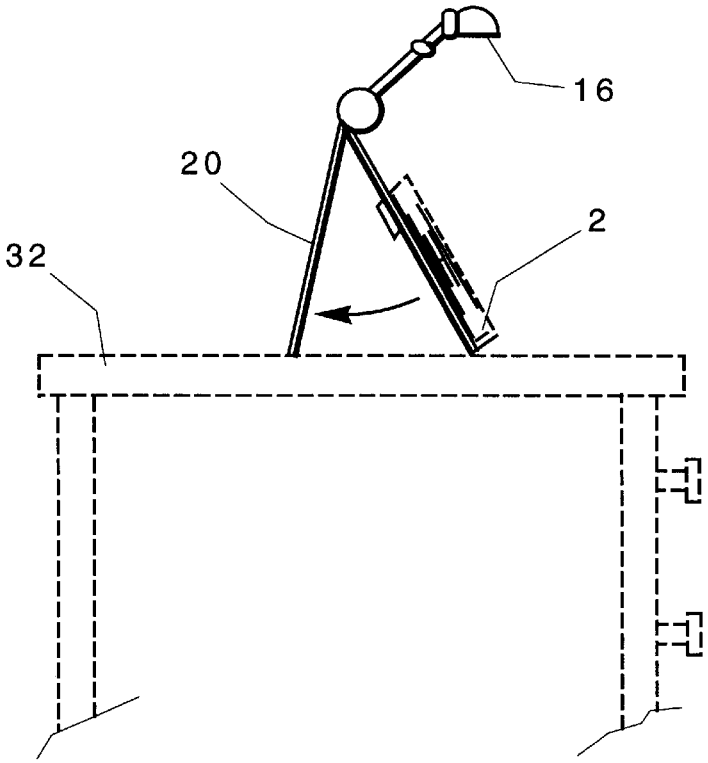
FIG. 4

BOOK HOLDER

FIELD OF INVENTION

This invention relates to supports for reading materials.

BACKGROUND OF THE INVENTION

Holding a book or copy in the hands for an extended time can be fatiguing and aggravate poor posture, especially when trying to read in bed. Further, the hands cannot be used therefore for writing or other uses. The present invention relieves the individual of such fatigue. While available book supports have adequate means for holding a book in an open position, they require several motions for turning a page.

U.S. Pat. No. 1,400,217 discloses a music holder having a finger piece at its base for moving forward a retaining frame while at the same time spreading music sheets for selection. While excellent for a marching band, this design would be unworkable with a book.

U.S. Pat. No. 3,981,522, incorporated herein by reference shows a book holder having a means of holding the book support in an upright position and having a pair of book holding bands and a strap for holding pages open. To turn the page, the book holder is partially closed, the page turned and then the book holder reopened. This requires that the support be hinged in some manner.

U.S. Pat. No. 4,159,836 discloses a book holder and reading locator having a transparent portion holding the book open. This holding portion is supported on both sides by pegs, which must be removed to turn the page.

U.S. Pat. No. 5,069,409, incorporated herein by reference, discloses a book holder having a trough and rod for supporting and retaining a book. Attached at the lower end of the support is a see through clamp to hold the book open and to allow for page turning, however, such a device would be unusable with a large floppy paperback book, still requires the use of one hand, cannot adequately accommodate both very thick and very thin volumes, and is clumsy for page turning of books which turn from left to right.

It is an object of this invention to provide a book holder which is useful with numerous styles of books, in a variety of settings which allows for rapid and easy turning of pages.

BRIEF DESCRIPTION OF THE DRAWINGS

FIG. 1 is a front perspective view of a book holder with a book.

FIG. 2 is a front perspective view of the same book holder without a book.

FIG. 3 is a back view of a book holder.

FIG. 4 is a side view of a book holder supported in a standing position on a piece of furniture.

BRIEF SUMMARY OF THE INVENTION

Figure 5:
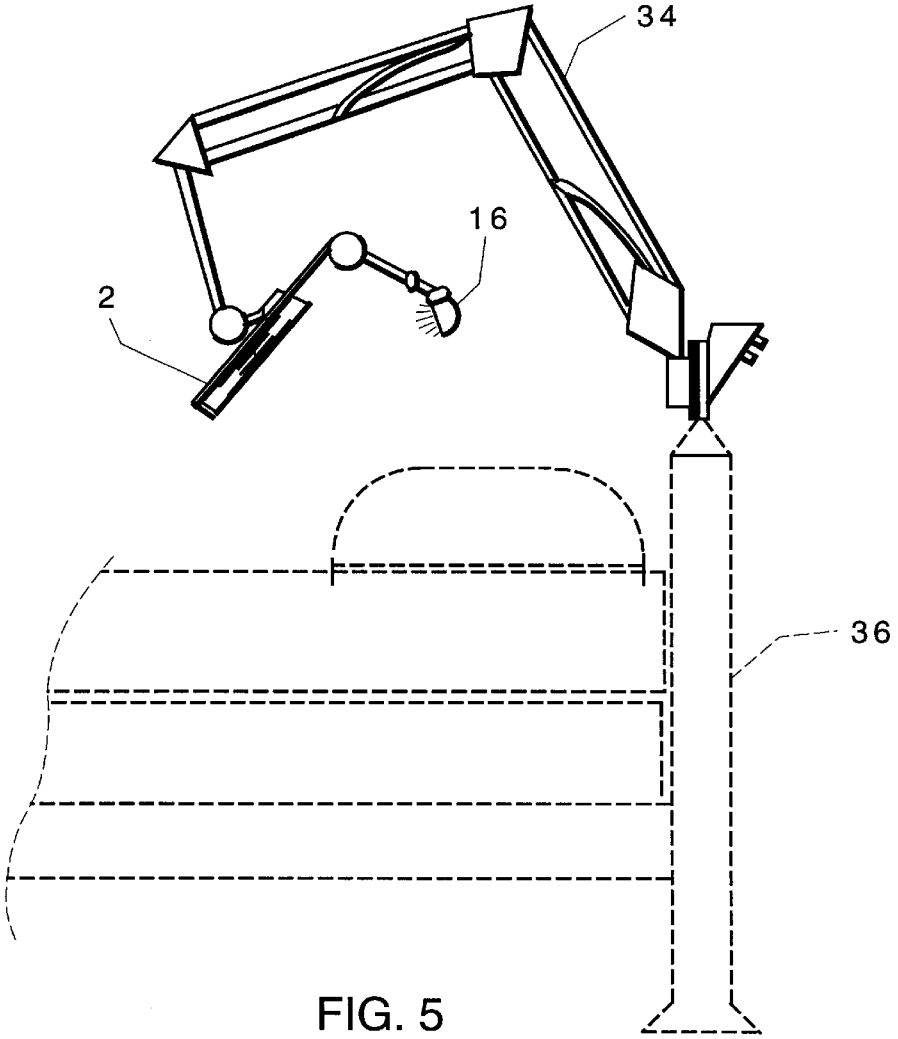
FIG. 5 is a side view of a book holder supported above a bed by an adjustable arm.

The book holder of the present invention appears like a clip board having the clip on the side and a lip on the bottom. The board is also provided with leaf supports such as ribbons or straps which can be fastened firmly against the back of the board. Such leaf supports are spaced apart so that each holds one outer leaf of the book. The clip is a lever having a means of attaching a transparent arm which extends to the opposite side of the board.

When the reader wishes to read a book, they simply press the clip, remove the transparent arm, and attach the book in place by the VELCRO straps. When the book is in place, the book is opened to the desired page, and the transparent arm slipped into place. To turn the page, the page is turned with one hand, while the other hand releases the clip.

DESCRIPTION OF THE PREFERRED EMBODIMENTS

FIG. 1 shows a book 4 resting on a lip 18 against a support 2. Leaf support straps 12 secures rear leaves of the book 4 firmly to the board 2. A lever in the form of a clip 8 is attached to the side of the support 2. For right-handed readers in a country which reads from left to right, the choice of sides is the left side, however, to accommodate others the clip 8 could be located on the right hand edge. A transparent arm 6 fits into a slot 10 of the clip 8. The arm is tapered to minimize the number of letters in a word that are distorted by the edge of the arm 6. The arm 6 could also be made large enough to cover the page. If the reader uses a magnifying glass, the transparent arm 6 could be a whole page magnifier. However, it is felt that the smaller tapered arm 6 is simpler for turning pages and there is less problems with glare. A finger tab 14 is provided on the clip for ease of working. An adjustable light 16 is mounted on the support board 2 for illuminating pages. The light 16 may be permanently mounted as shown, or be detachably mounted, for example by hook and loop fasteners such as available under the VELCRO trade name. It is also thought that by choosing the composition of the arm 6 carefully, a light might be internally reflected within the arm in a manner similar to an optic fiber, and then allowed to exit onto the book 2. Such a system would require less electricity, and could be mounted within the clip 8.

FIG. 3 shows the back of the book holder. The leaf supports 12 are fastened to a corresponding hook and loop fastener 26. Clip type leaf fasteners would also work. A stand support 20 is attached pivotally at 22 onto the support 2. It is held in place a clip 24. When the stand support 20 is pivoted to the rear it can be set on furniture such as a desk 32.

A slide type support 30 is used to attach the book holder to one end of an adjustable arm 34. The adjustable arm may be a mechanical swing arm as shown or a continuously bendable arm, preferably having at least 4 segments. The other end of the arm 34 is attached to an environmental support such as a chair, or bed 36.

Figure 6:
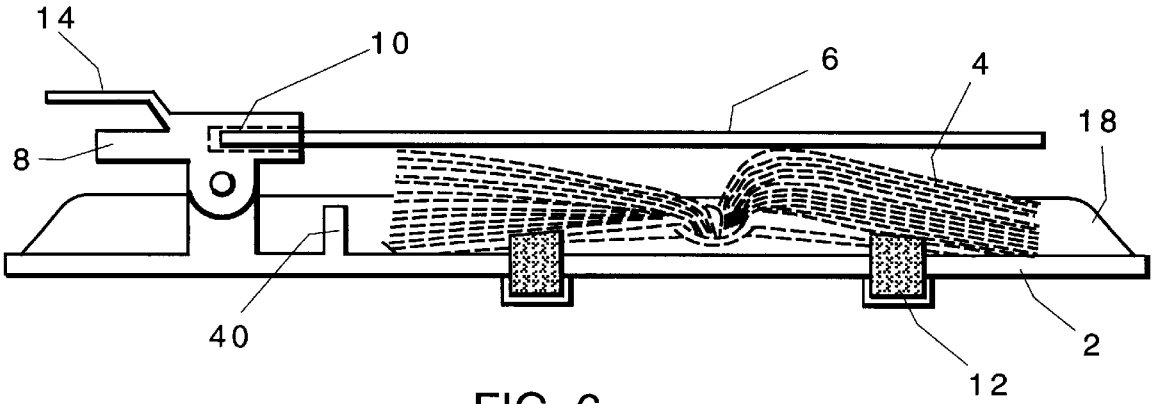
FIG. 6 shows a top view of a book holder having a planar transparent arm.

FIG. 6 is a top view of a book holder having a planar transparent arm 6, which is slid into the slot 10. To guide the placement of the book 4, the holder is provided with a stop 40.

Figure 7:
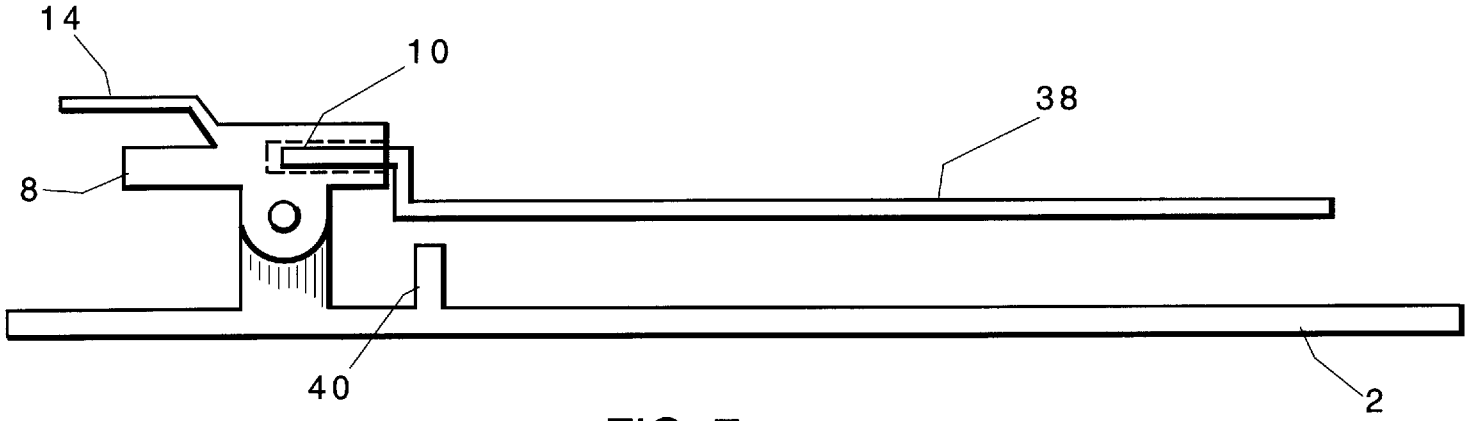
FIG. 7 shows a top view of a book holder having a nonplanar arm positioned for a narrow book.
Figure 8:
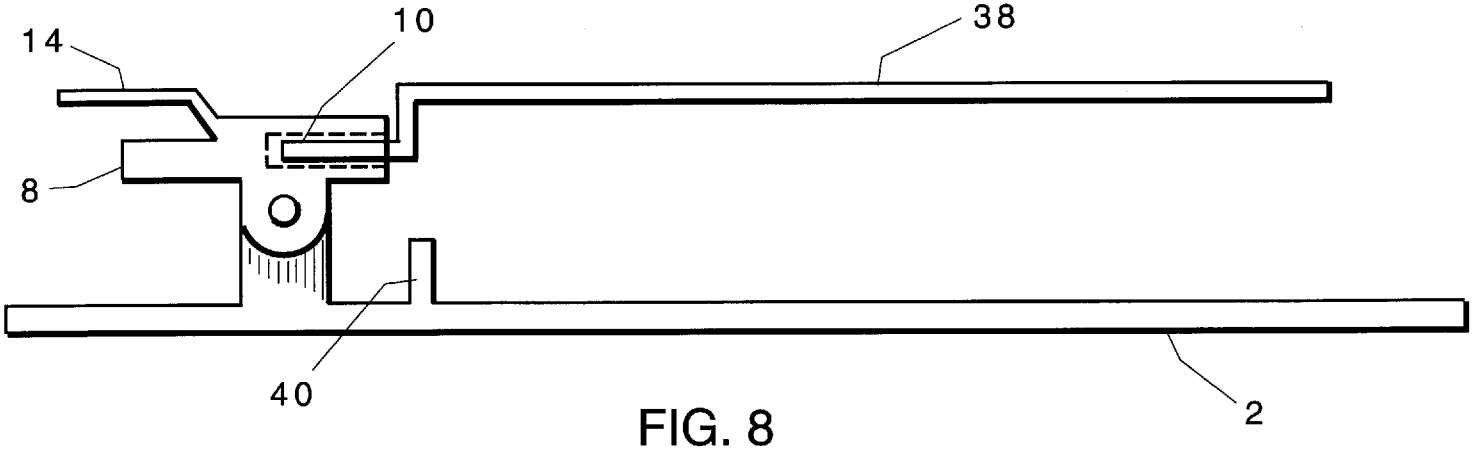
FIG. 8 shows a top view of a book holder having a nonplanar arm positioned for a wide book.

FIGS. 7 and 8 show a similar book holder having a nonplanar transparent arm 38. The nonplanar arm 38 can be set for a book of minimum thickness as in FIG. 7, or a book of maximum thickness, as shown in FIG. 8.

Although the design is flexible, it may be necessary to have different sizes of supports and transparent arms. It is also possible that a clamp having a removable arm would find use in other applications such as gluing.

The support can be made from a number of materials, such as plastic, metal and wood. The support must be sufficiently rigid to support a book 4 and a clip 8 having a compressive device such as a spring. The spring clip could be made of a rigid material strong enough to hold a minimum of pages in book open at any time. If straps 12 are used to hold the book, they could be made from ribbon, cloth, leather or any material that is flexible, strong and free of sharp edges. However, the outermost leaves of the book may also be held by pocket or clip like devices.

For heavy books which tend to slide, the leaf holder could be modified to include a third strap 28, sewn perpendicular to the two straps, half way down the support. The third strap can be long enough to extend about 4 to 5 cm. around to the back of the support 2 and attach with hook and loop fasteners 26 so that when the support 2 is tipped, the book 4 will not slide.

The transparent arm 6 which holds the open leaves flat when in place could be made from a rigid, transparent material such as plastic or glass. Illuminated models which use a lamp 16 work best if the light is attached to the top center of the support. It is best if the light 16 has a 12 to 18 cm. adjustable arm that can be folded flat against the support board 2 when not in use, or be removable.

The clip 8 can be made as a two piece spring clip molded from plastic and joined together to form a slot 10 for the arm 6 with a steel rod and spring.

The book holder may be designed to include a vanity mirror, pen or pencil holder, or memo pad holder.

What is claimed is:

1. A book holder comprising:

a support for a book, said support having two side edges and one bottom edge;

a lever located at a single permanent position on one of said side edges wherein a first arm of said lever has a finger piece and a second arm has a transparent portion; and a compressive device for urging said second arm against said book, wherein said transparent portion is detachable from a side of said fingerpiece, said side of said fingerpiece being toward the furthest of said two side edges.

2. The book holder of claim 1 wherein a portion of said transparent portion forms a male member and a portion of said lever forms a female member of a joint.

3. The book holder of claim 2 wherein said female portion is a slot.

4. The book holder of claim 2 wherein said support is generally rectangular in shape and is provided with a lip on said bottom edge for supporting said book.

5. The book holder of claim 2 further comprising leaf holders for retaining outer leaves against said support.

6. The book holder of claim 5 wherein said leaf holders are straps.

7. A book holder comprising:

a support for a book, said support having two sides and one bottom edges;

a lever located at a single position one of said side edges wherein a first arm of said lever has a finger piece and a second arm has a transparent portion; and a compressive device for urging said second arm against said book, wherein said transparent portion is detachable wherein said detachable transparent portion has a viewing area for covering a book, being substantially in one plane, and an attachment means wherein said attachment means is spaced from said one plane of said viewing area, such that by detaching and repositioning said portion, material of differing thickness can be accommodated.

8. The book holder of claim 7 wherein said detachable portion is stepped.

9. A book holder comprising:

a support for a book, said support having two side edges and one bottom edge;

a lever located at a single permanent position on one of said side edges wherein a first arm of said lever has a finger piece and a second arm has a transparent portion; and a compressive device for urging said second arm against said book, wherein said transparent portion is tapered.

10. A book holder comprising:

a support for a book, said support having two side and one bottom edges;

a spring clip located at one of said side edges, said clip having a finger piece and a slot;

a transparent tapered arm, having a portion which slides into said slot, and is biased by said clip towards said support;

a set of straps attached to said support for retaining outer leaves of said book;

hook and loop fastening means on said support for securing said straps; and a lip located at the lower edge of said support.

11. The book holder of claim 10 further comprising:

a means of illuminating said book; and a means of supporting said book holder.

12. The book holder of claim 11 wherein said book holder supporting means is chosen from the group consisting of adjustable arms and folding supports.

* * * * *